US009452334B2

(12) United States Patent
Ko

(10) Patent No.: US 9,452,334 B2
(45) Date of Patent: Sep. 27, 2016

(54) MODULAR BASKETBALL BACKBOARD WITH RIM

(71) Applicant: Ching Ho Ko, Xianxi Township, Changhua County (TW)

(72) Inventor: Ching Ho Ko, Xianxi Township, Changhua County (TW)

( * ) Notice: Subject to any disclaimer, the term of this patent is extended or adjusted under 35 U.S.C. 154(b) by 44 days.

(21) Appl. No.: 14/467,336

(22) Filed: Aug. 25, 2014

(65) Prior Publication Data

US 2016/0051874 A1 Feb. 25, 2016

(51) Int. Cl.
*A63B 63/08* (2006.01)
*A63B 5/11* (2006.01)

(52) U.S. Cl.
CPC ..... *A63B 63/083* (2013.01); *A63B 5/11* (2013.01); *A63B 2209/00* (2013.01); *A63B 2210/50* (2013.01)

(58) Field of Classification Search
CPC ..... A63B 63/08
USPC ..... 473/482, 481, 483; 248/73; 40/662; 411/38, 516; 52/718.02; D22/108
See application file for complete search history.

(56) References Cited

U.S. PATENT DOCUMENTS 2,230,813 A * 2/1941 Pressman ..... A63B 63/083 248/315
3,582,078 A * 6/1971 Katras ..... A63B 63/08 273/394
5,149,027 A * 9/1992 Weber ..... F16L 3/2235 24/459
5,827,136 A * 10/1998 Halter ..... A63B 63/083 473/447
5,910,058 A * 6/1999 Zheng ..... A63B 63/083 473/481
6,565,460 B2 * 5/2003 Wang ..... A63B 63/083 473/431
9,084,908 B1 7/2015 Chen
2001/0006074 A1 * 7/2001 Zheng ..... A63B 9/00 135/126
2002/0068650 A1 * 6/2002 Wang ..... A63B 63/083 473/479
2004/0266567 A1 * 12/2004 O'Neill ..... A63B 63/083 473/481
2008/0081713 A1 * 4/2008 Huang ..... A63B 63/083 473/481
2016/0051874 A1 * 2/2016 Ko ..... A63B 63/083 473/482

OTHER PUBLICATIONS

Webpage download, Youtube2012 , 2012, https://www.youtube.com/watch?v=8s7tyM1vMLU, 12 pages.*
Webpage download, Amazon2013 , 2013, https, 1 page.*
Webpage download, Jcrondiy2011 , 2011, https://web.archive.org/web/20110801000000*/http://jcrondiy.com/panel.html , 2 pages.*

* cited by examiner

*Primary Examiner* — Gene Kim
*Assistant Examiner* — M Chambers
(74) *Attorney, Agent, or Firm* — Clement Cheng

(57) ABSTRACT

A modular basketball backboard with a rim contains: a backboard, a rim, and three fixing ropes. The backboard includes a first front face and a first back face, and the first back face has a longitudinal adjusting rope secured thereon. The rim is mounted on the first front face of the backboard. Two ends of two of the three fixing ropes are inserted and tied on two sides of the backboard, and one end of another of the three fixing ropes is tied on the longitudinal adjusting rope of the first back face of the backboard. The backboard and the rim are fixed and suspended by tying the three fixing ropes for shooting a basketball into the rim. Thereby, the backboard and the rim are fixed, removed, and height adjustable easily. Preferably, the modular basketball backboard with the rim cooperates with a bouncer to enhance convenience and entertainment.

5 Claims, 8 Drawing Sheets

MODULAR BASKETBALL BACKBOARD WITH RIM

BACKGROUND OF THE INVENTION

1. Field of the Invention

The present invention relates to a basketball backboard with a rim and, more particularly, to a modular basketball backboard with a rim in which a backboard and a rim are fixed and suspended by tying three fixing ropes.

2. Description of the Prior Art

Playing basketball is a popular sport and means shooting the basketball into a rim locked on a backboard. The backboard is mounted on a positioning mount or a fixing face, so the rim is fixed and removed inconveniently. Moreover, the backboard with the rim is bulky and is delivered difficulty, and it cannot be adjusted to a desired height based on using requirements.

The present invention has arisen to mitigate and/or obviate the afore-described disadvantages.

SUMMARY OF THE INVENTION

The primary objective of the present invention is to provide a modular basketball backboard with a rim. A backboard and a rim are fixed and suspended by tying three fixing ropes on three columns, and the rim retains with the backboard, thus fixing and removing the backboard and the rim and adjusting their height easily. Preferably, the modular basketball backboard with the rim cooperates with a bouncer to enhance convenience and entertainment.

Another objective of the present invention is to provide a modular basketball backboard with a rim in which the three fixing ropes are tied on the three columns tightly, so that the backboard and the rim are suspended, thus increasing safety and using requirements.

To obtain the above objectives, a modular basketball backboard with a rim provided by the present invention contains: a backboard, a rim, and three fixing ropes.

The backboard includes a body and a covering disc. The body has a first front face and a first back face, and the first front face has a hole with two stepped sections defined on a lower side thereof. The covering disc has a second front face, a second back face, an opening formed on a peripheral side thereof to accommodate the body in the covering disc from the opening, a zipper mounted on the opening to open and close the opening, a through orifice arranged on the second front face of the covering disc corresponding to the hole of the body, and a longitudinal adjusting rope secured on the second back face of the covering disc. The rim has an inserting portion extending outwardly from a peripheral side thereof, such that the inserting portion inserts into the hole of the body via the through orifice of the covering disc. Two ends of two of the three fixing ropes are inserted and tied on two sides of the covering disc, and one end of another of the three fixing ropes is tied on the longitudinal adjusting rope of the second back face of the covering disc. The backboard and the rim are fixed and suspended by tying the three fixing ropes for shooting a basketball into the rim.

DETAILED DESCRIPTION OF THE PREFERRED EMBODIMENTS

Figure 1:
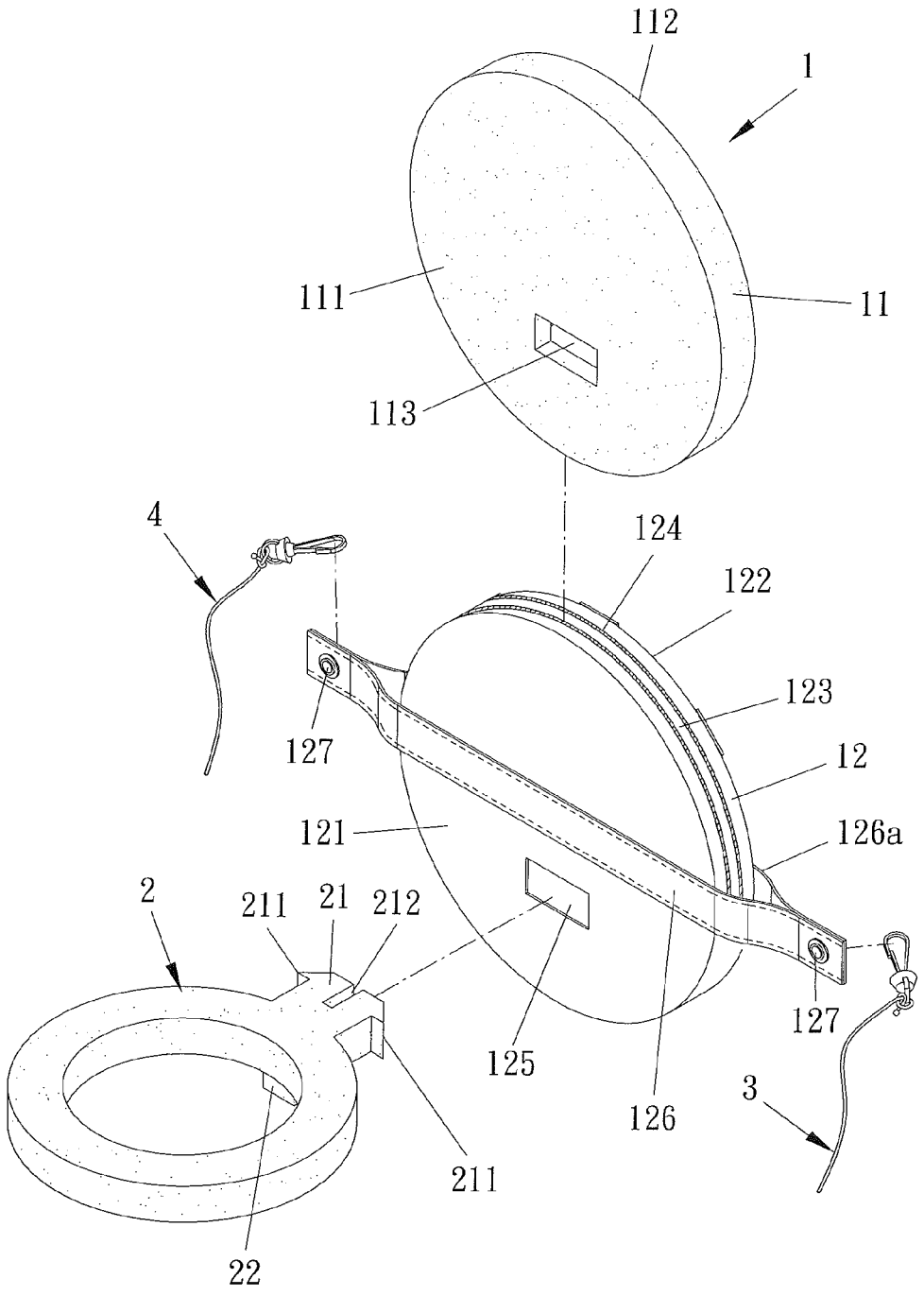
FIG. 1 is a perspective view showing the exploded components of a modular basketball backboard with a rim according to a preferred embodiment of the present invention.
Figure 2:
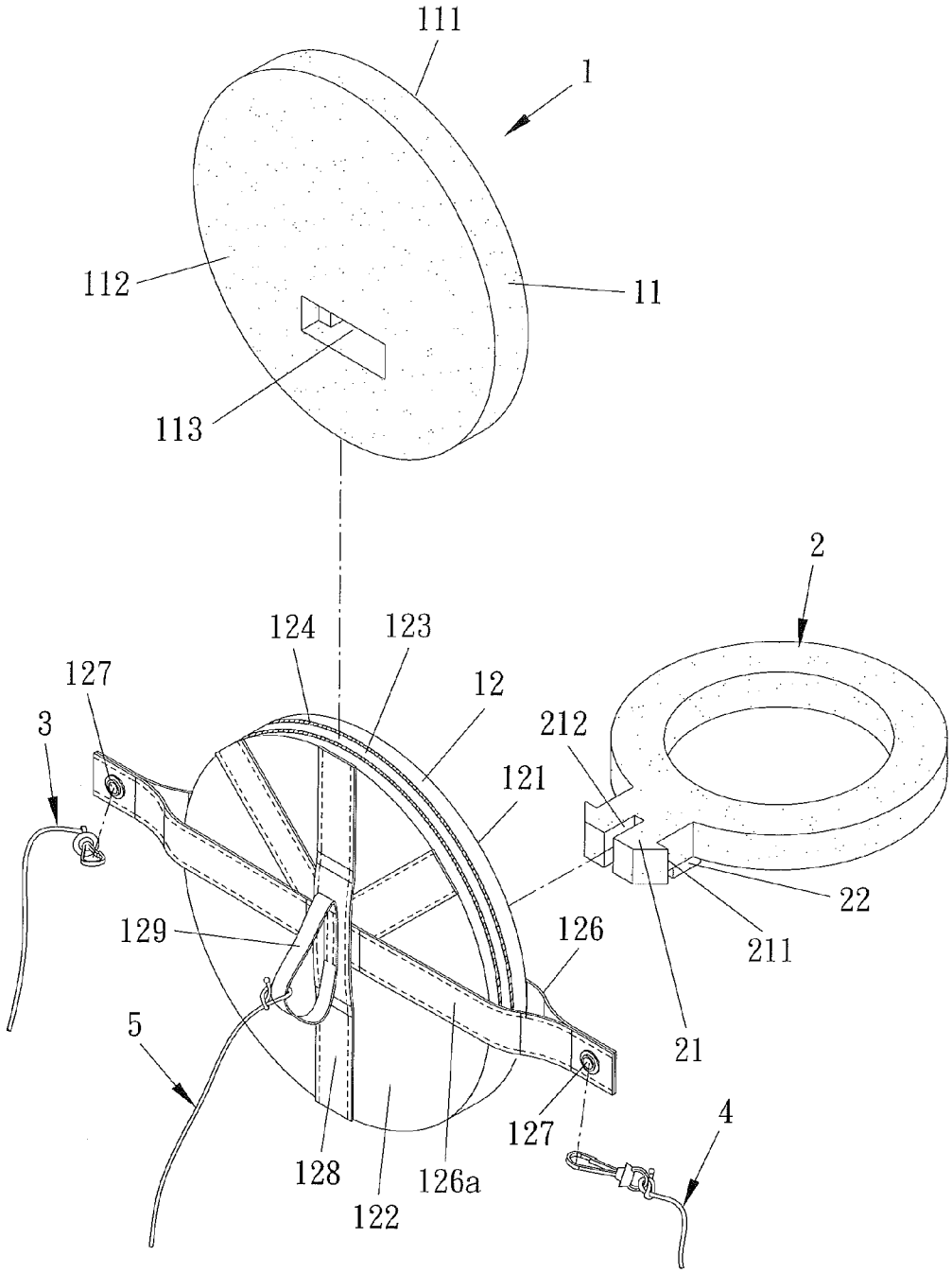
FIG. 2 is another perspective view showing the exploded components of the modular basketball backboard with the rim according to the preferred embodiment of the present invention.
Figure 3:
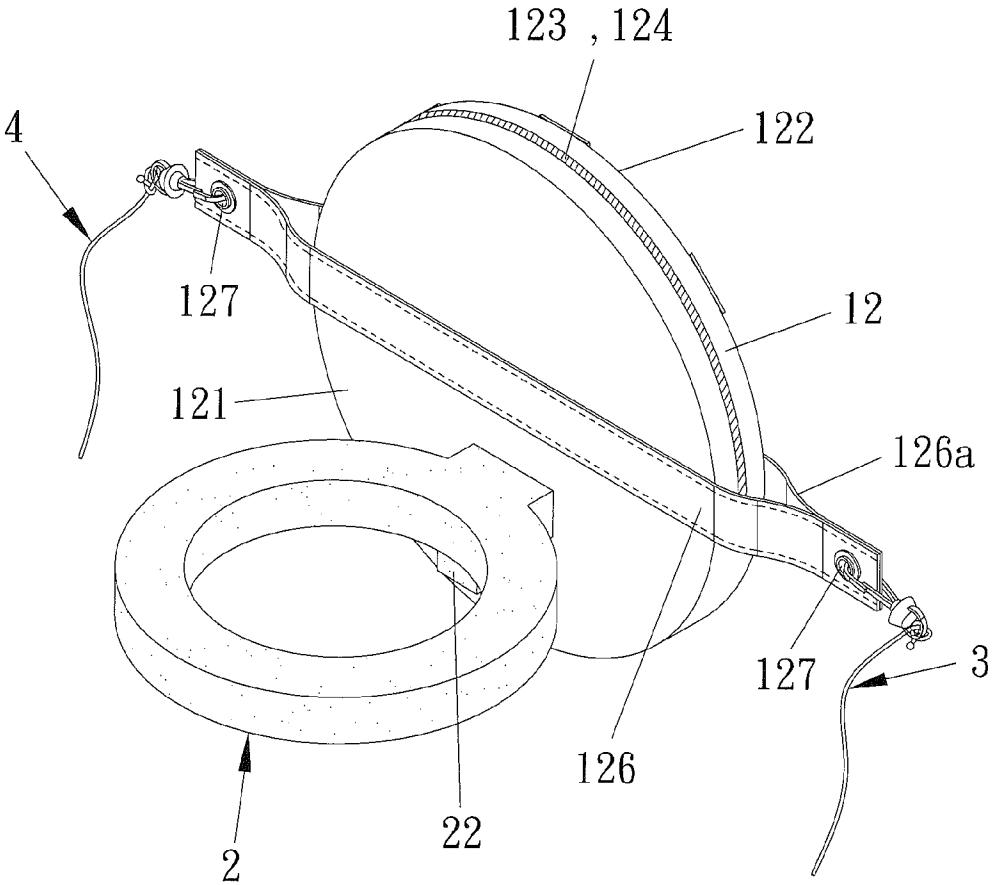
FIG. 3 is a perspective view showing the assembly of the modular basketball backboard with the rim according to the preferred embodiment of the present invention.
Figure 4:
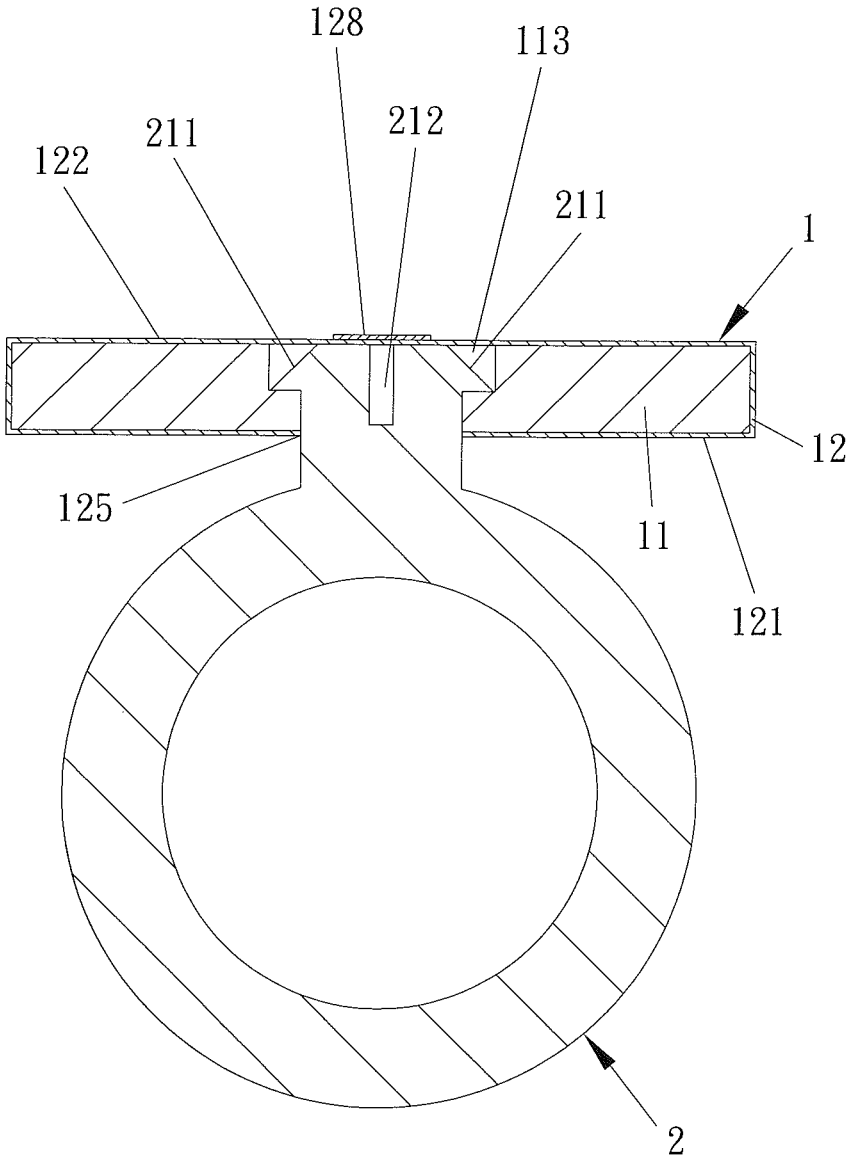
FIG. 4 is a cross sectional view showing the assembly of the modular basketball backboard with the rim according to the preferred embodiment of the present invention.
Figure 5:
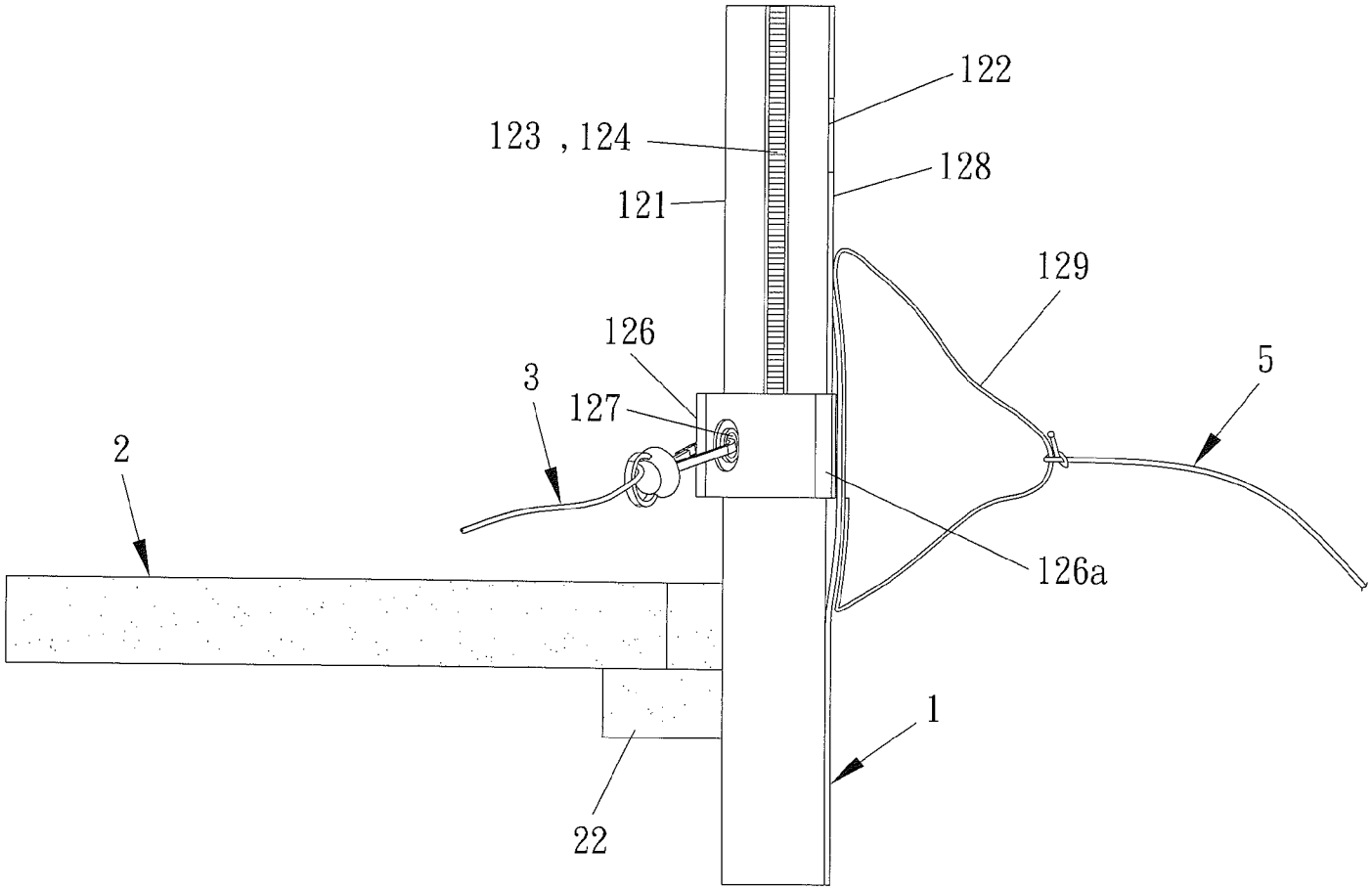
FIG. 5 is a side plan view showing the assembly of the modular basketball backboard with the rim according to the preferred embodiment of the present invention.

The present invention will be clearer from the following description when viewed together with the accompanying drawings, which show, for purpose of illustration only, the preferred embodiments in accordance with the present invention.

With reference to FIGS. 1-5, a modular basketball backboard with the rim according to a preferred embodiment of the present invention comprises: a backboard 1, a rim 2, and three fixing ropes 3, 4, 5. The backboard 1 includes a body 11 and a covering disc 12. The body 11 is formed in a circular disc shape and is made of foam material. The body 11 has a first front face 111 and a first back face 112, and the first front face 111 has a hole 113 with two stepped sections defined on a lower side thereof. The covering disc 12 is hollow and has a profile corresponding to a profile of the body 11. The covering disc 12 has a second front face 121, a second back face 122, an opening 123 formed on a peripheral side thereof to accommodate the body 11 in the covering disc 12 from the opening 123, a zipper 124 mounted on the opening 123 to open and close the opening 123, a through orifice 125 arranged on the second front face 121 of the covering disc 12 corresponding to the hole 113 of the body 11, a first ribbon 126 horizontally extending on the second front face 121 of the covering disc 12, a second ribbon **126*a* horizontally extending on the second back face 122 of the covering disc 12, two apertures 127 formed on two sides of the first ribbon 126 and the second ribbon 126*a*, a third ribbon 128 vertically extending on the second back face 122 of the covering disc 12, and a longitudinal adjusting rope 129 secured on the third ribbon 128. The rim 2 is formed in a circular loop shape and is made of foam material. The rim 2 has an inserting portion 21 extending outwardly from a peripheral side thereof, and two reinforced protrusions 22 arranged on two sides of the inserting portion 21. The inserting portion 21 has two hooks 211 extending outwardly from two sides of a lower end thereof and has a slot 212 defined between the two hooks 211, such that the inserting portion 21 inserts into the hole 113 of the body 11 via the through orifice 125 of the covering disc 12 of the backboard 1. The two hooks 211 of the inserting portion 21** retain with the two stepped sections of the hole 113, and the two reinforced protrusions 22 contact with the backboard 1 to reinforce the rim 2. Two ends of two fixing ropes 3, 4 of the three fixing ropes 3, 4, 5 are inserted and tied on the two apertures 127 of the covering disc 12 through the covering disc 12 of the backboard 1, and one end of another fixing rope 5 of the three fixing ropes 3, 4, 5 is tied on the longitudinal adjusting rope 129 of the second back face 122 of the covering disc 12 of the backboard 1.

Figure 6:
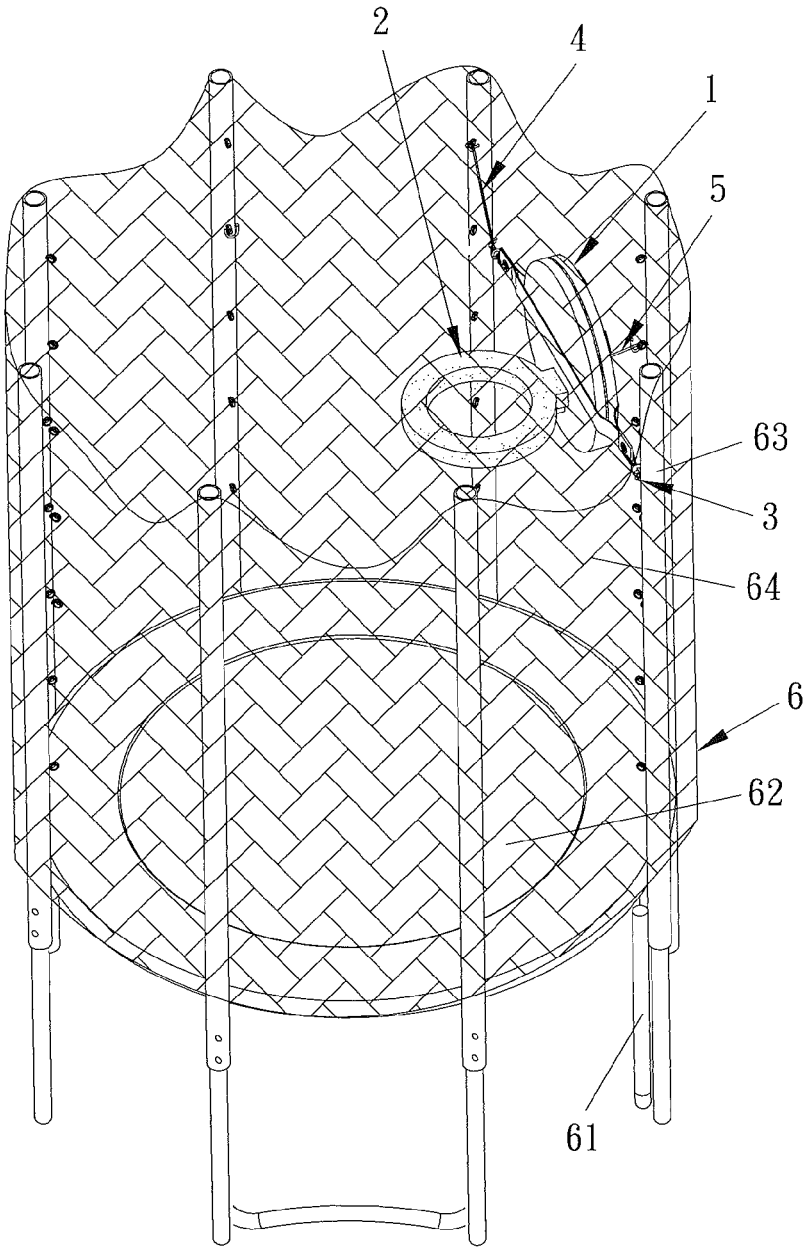
FIG. 6 is a perspective view showing the modular basketball backboard with the rim matching with a bouncer according to the preferred embodiment of the present invention.
Figure 7:
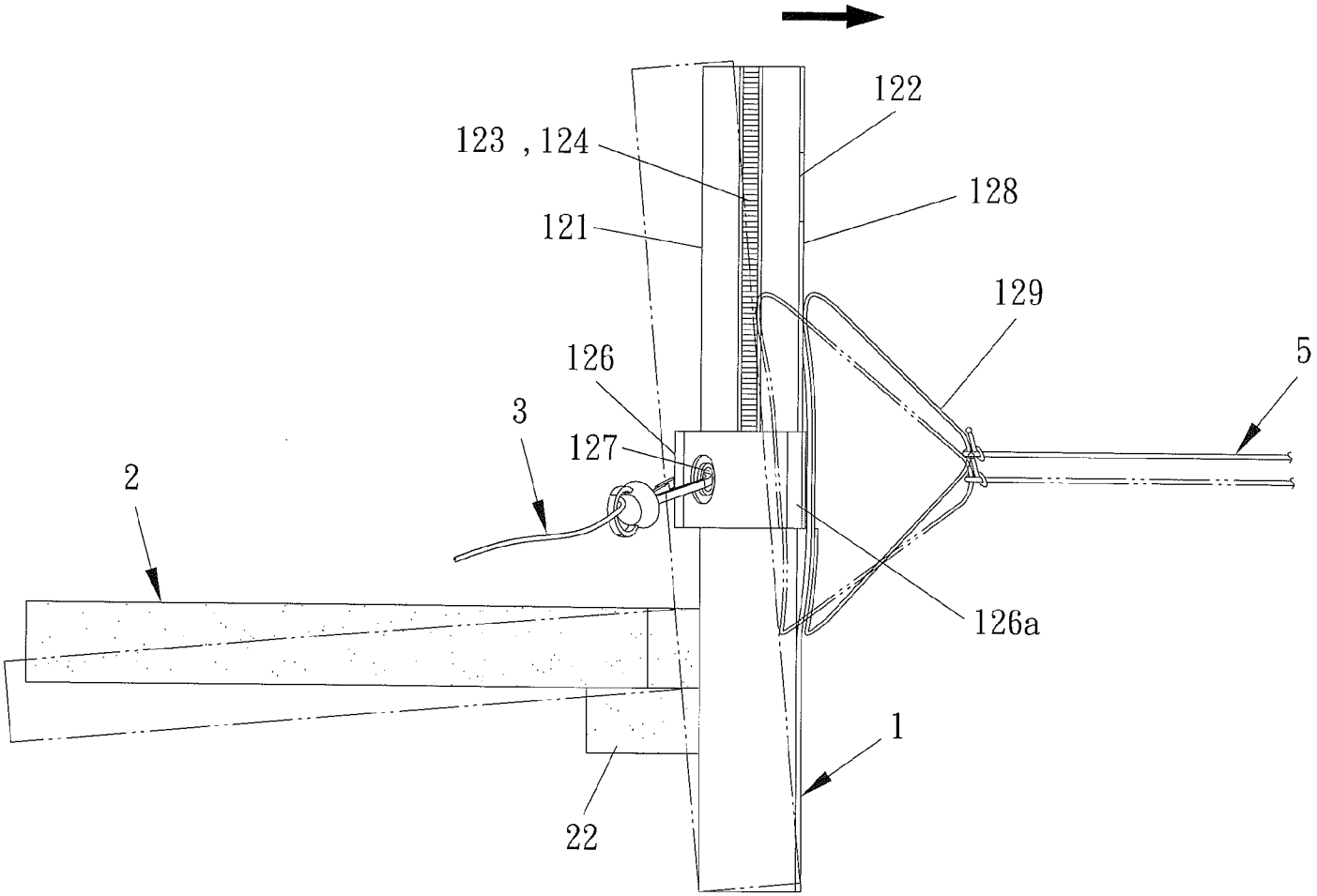
FIG. 7 is a side plan view showing the operation of the modular basketball backboard with the rim according to the preferred embodiment of the present invention.

In use, as shown in FIG. 6, the modular basketball backboard with the rim cooperates with a bouncer 6. The bouncer 6 has a support frame 61, a mesh 62 connecting with the support frame 61 by ways of a plurality of resilient elements (not shown), plural columns 63 extending upwardly from the support frame 61, and a protective net 64 surrounding around the plural columns 63. The three fixing ropes 3, 4, 5 are tied on the plural columns 63 of the bouncer 6 and then are pulled tightly, and the backboard 1 and the rim 2 are fixed in the protective net 64 of the bouncer 6 for shooting a basketball into the rim 2. When the rim 2 does not keep horizontal, as shown in FIG. 7, a fixing rope 5 is tied on the longitudinal adjusting rope 129 of the second back face 122 of the covering disc 12 of the backboard 1, so that the backboard 1 is located vertically and so that the rim 2 is fixed horizontally.

Figure 8:
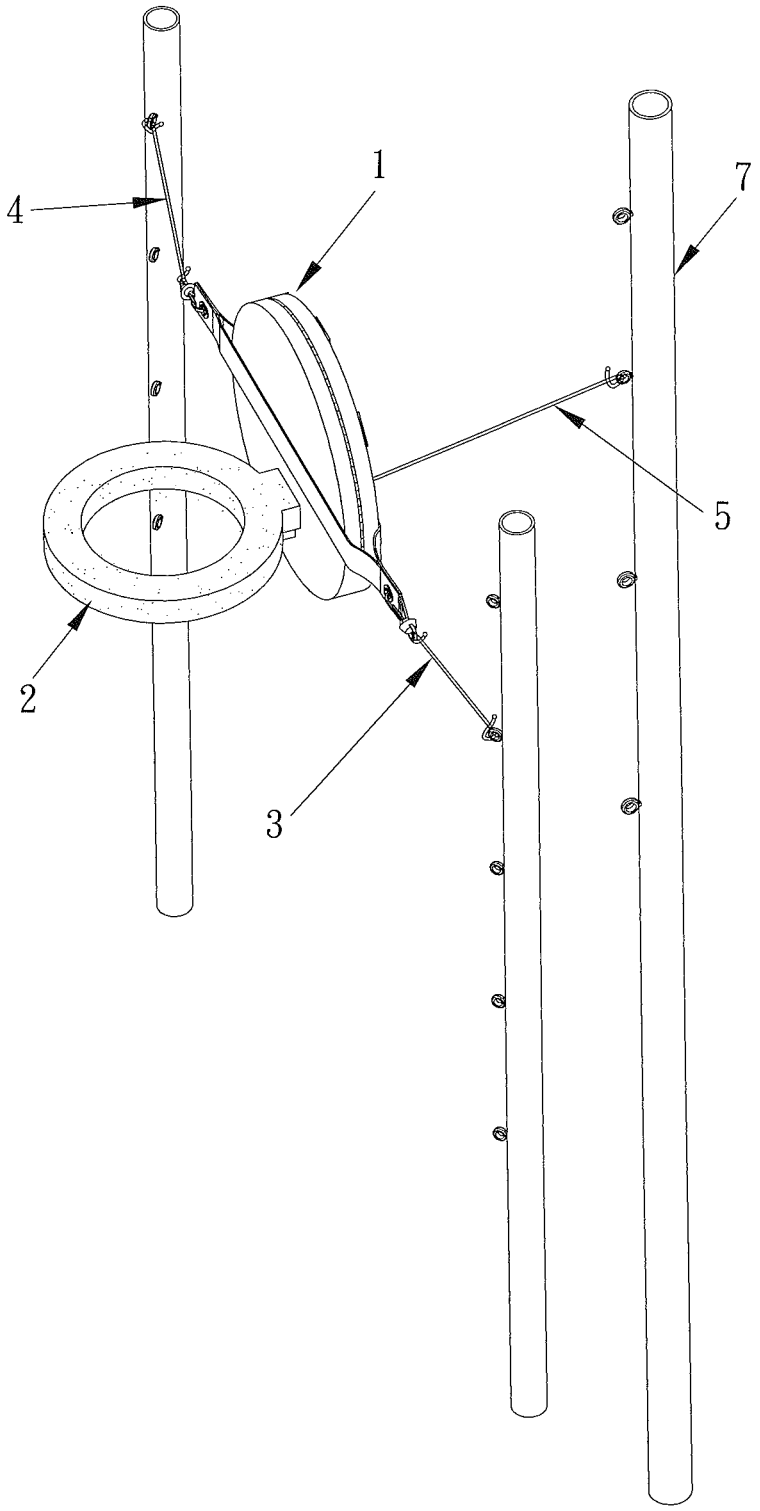
FIG. 8 is a perspective view showing the operation of the modular basketball backboard with the rim according to the preferred embodiment of the present invention.

As illuminated in FIG. 8, in use, the modular basketball backboard with the rim matches with three columns 7. The three columns 7 are erected at three positions (i.e., three peak positions of a triangle) of a ground, and the three fixing ropes 3, 4, 5 are tied on the three columns 7 tightly. Hence, the backboard 1 and the rim 2 are suspended, so that a user shoots the basketball into the rim 2.

In details, the three fixing ropes 3, 4, 5 are tied on three positions of the three columns 7 tightly so that the backboard 1 and the rim 2 are suspended, and so that the user shoots the basketball into the rim 2.

Thereby, the modular basketball backboard with the rim of the present invention has advantages as follows:

1. The backboard 1 and the rim 2 are fixed and suspended by tying three fixing ropes 3, 4, 5 on the three columns 7 which are erected on the three peak positions of the triangle of the ground. The rim 2 retains with the backboard 1, thus fixing and removing the backboard 1 and the rim 2 and adjusting their height easily. Preferably, the modular basketball backboard with the rim cooperates with the bouncer 6 to enhance convenience and entertainment.

2. The three fixing ropes 3, 4, 5 are tied on the three positions of the three columns 7 tightly so that the backboard 1 and the rim 2 are suspended. The body 11 and the rim 2 are made of the foam material, thus increasing safety and using requirements.

While various embodiments in accordance with the present invention have been shown and described, it is clear to those skilled in the art that further embodiments may be made without departing from the scope of the present invention.

What is claimed is:

1. A modular basketball backboard assembly comprising:

a backboard including a first front face and a first back face, with the first back face having a longitudinal adjusting rope secured thereon, wherein the first front face has a hole with two stepped sections defined on a lower side thereof;

a rim formed in a circular loop shape and having an inserting portion extending outwardly from a peripheral side thereof, wherein the inserting portion is T-shaped having two hooks extending outwardly from two sides of a lower end thereof and has a slot defined between the two hooks and extending toward the lower end, wherein the lower end of the inserting portion is inserted into the hole and the two hooks are inside the hole and spaced from the first front face of the body of the backboard, wherein the lower end and the two hooks of the inserting portion are retained with the two stepped sections of the hole; and three fixing ropes, wherein two ends of two of the three fixing ropes are inserted and tied on two sides of the backboard, and wherein one end of another of the three fixing ropes is tied on the longitudinal adjusting rope of the first back face of the backboard, and wherein the backboard and the rim are fixed and suspended by tying the three fixing ropes for shooting a basketball into the rim wherein the backboard includes including a body and a covering disc, wherein the body is made of a foam material and has a first front face and a first back face, wherein the first front face has a hole with two stepped sections defined on a lower side thereof, wherein the covering disc is hollow and has a profile corresponding to a profile of the body, wherein the covering disc has a second front face, a second back face, an opening formed on a peripheral side thereof to accommodate the body in the covering disc from the opening, a zipper mounted on the opening to open and close the opening, and a through orifice arranged on the second front face of the covering disc corresponding to the hole of the body a longitudinal adjusting rope secured on the second back face spaced from the peripheral side and wherein a rim inserted into the through orifice and the hole of the backboard and wherein the rim is made of a foam material and wherein the inserting portion inserts into the hole of the body via the through orifice of the covering disc of the backboard, and wherein the inserting portion retains with the two stepped sections of the hole.

2. The modular basketball backboard assembly as claimed in claim 1, wherein the rim also has two reinforced protrusions arranged on two sides of the inserting portion to contact with the backboard and to reinforce the rim.

3. The modular basketball backboard assembly claimed in claim 1, further comprising two reinforced protrusions on the lower end of the inserting portion contacting the first front face of the backboard.

4. The modular basketball backboard assembly claimed in claim 3, wherein the two hooks are flush with the first back face of the backboard.

5. The modular basketball backboard assembly as claimed in claim 1, wherein the covering disc has a first ribbon horizontally extending on the second front face thereof, a second ribbon horizontally extending on the second back face thereof, two apertures formed on two sides of the first ribbon and the second ribbon, a third ribbon vertically extending on the second back face of the covering disc, and the longitudinal adjusting rope secured on the third ribbon.

* * * * *